US007488133B2

(12) United States Patent
Kuo

(10) Patent No.: US 7,488,133 B2
(45) Date of Patent: Feb. 10, 2009

(54) LIP GLOSS AND BRUSH ASSEMBLY

(75) Inventor: An-Kung Kuo, Lu Kang Chen (TW)

(73) Assignee: Lo Mei Cosmetics Enterprise Co., Ltd., Changhua Hsien (TW)

( * ) Notice: Subject to any disclaimer, the term of this patent is extended or adjusted under 35 U.S.C. 154(b) by 429 days.

(21) Appl. No.: 11/358,565

(22) Filed: Feb. 21, 2006

(65) Prior Publication Data

US 2007/0009318 A1 Jan. 11, 2007

(30) Foreign Application Priority Data

Jul. 5, 2005 (TW) ..... 94211362 U

(51) Int. Cl.
*A47L 13/22* (2006.01)
*A46B 17/04* (2006.01)

(52) U.S. Cl. ..... 401/281; 401/280; 401/269

(58) Field of Classification Search ..... 401/269, 401/280, 281, 202, 270, 183, 184
See application file for complete search history.

(56) References Cited

U.S. PATENT DOCUMENTS 4,902,152 A * 2/1990 Seidler ..... 401/117

* cited by examiner

*Primary Examiner*—David J Walczak
(74) *Attorney, Agent, or Firm*—Alan Kamrath; Kamrath & Associates PA

(57) ABSTRACT

A lip gloss and brush assembly includes a container, a fixed member secured in the container, a rotation member rotatably mounted in the fixed member, a brush mounted in the rotation member, and a cover mounted on the container and secured to the rotation member. Thus, the rotation member is rotated by the cover to open or close flow of the lip gloss contained in the inside of the container, so that the lip gloss and brush assembly is operated easily and conveniently. In addition, the flow of the lip gloss is controlled by rotation of the cover, so that the lip gloss is allowed to flow smoothly and constantly without being choked, thereby enhancing the working condition of the lip gloss and brush assembly.

14 Claims, 6 Drawing Sheets

LIP GLOSS AND BRUSH ASSEMBLY

BACKGROUND OF THE INVENTION

1. Field of the Invention

The present invention relates to a lip gloss and brush assembly and, more particularly, to a lip gloss and brush assembly containing the lip gloss and lip brush.

2. Description of the Related Art

A conventional lip gloss and brush assembly in accordance with the prior art shown in FIGS. 6-8 comprises a container 10, a fixed sleeve 11, a movable sleeve 12, a brush 14, a retaining cap 15, and a cover 16. The container 10 is a soft compressible body and contains a lip gloss therein. The container 10 has an end portion formed with an outlet 101 having an outer thread. The. fixed sleeve 11 is secured in the outlet 101 of the container 10 and has an inside formed with a mounting recess 114 and a peripheral wall formed with an inlet 113 connected to the mounting recess 114 and an inside of the container 10. The fixed sleeve 11 has two ends each formed with a locking flange 111 locked on the outlet 101 of the container 10 to secure the fixed sleeve 11 to the outlet 101 of the container 10. The mounting recess 114 of the fixed sleeve 11 has a top formed with a limit flange 115. The movable sleeve 12 is movably mounted in the mounting recess 114 of the fixed sleeve 11 and has an inside formed with a receiving recess 123 connected to the mounting recess 114 of the fixed sleeve 11. The movable sleeve 12 has a mediate portion formed with a limit flange 121 that is movable to abut the limit flange 115 of the fixed sleeve 11 and has an upper end formed with a mounting portion 124 having an annular stop flange 122 protruded from the mounting recess 114 of the fixed sleeve 11. A spring 13 is mounted on the movable sleeve 12 and biased between the limit flange 121 of the movable sleeve 12 and the bottom wall of the fixed sleeve 11 to push the movable sleeve 12 upward. The brush 14 is mounted in the receiving recess 123 of the movable sleeve 12. The retaining cap 15 is mounted on the mounting portion 124 of the movable sleeve 12 and rested on the stop flange 122 of the movable sleeve 12 to retain the brush 14 in the movable sleeve 12. The cover 16 is mounted on the outlet 101 of the container 10 to cover the brush 14 and has an inner wall formed with a press edge 161 rested on the stop flange 122 of the movable sleeve 12.

As shown in FIGS. 6 and 8, after the cover 16 is removed from the outlet 101 of the container 10, the spring 13 pushes the movable sleeve 12 upward to connect the receiving recess 123 of the movable sleeve 12 to the mounting recess 114 of the fixed sleeve 11. Thus, when the container 10 is compressed by a user, the lip gloss contained in the inside of the container 10 is compressed to flow through the inlet 113 and the mounting recess 114 of the fixed sleeve 11 into the receiving recess 123 of the movable sleeve 12 to be absorbed by the brush 14 for use with the user.

As shown in FIGS. 6 and 7, after the cover 16 is mounted on the outlet 101 of the container 10, the press edge 161 of the cover 16 is rested on the stop flange 122 of the movable sleeve 12 to compress the spring 13 and to press the movable sleeve 12 downward to interrupt the connection between the receiving recess 123 of the movable sleeve 12 and the mounting recess 114 of the fixed sleeve 11 to prevent the lip gloss contained in the inside of the container 10 from entering the receiving recess 123 of the movable sleeve 12.

However, the spring 13 is immersed in the lip gloss, so that the spring 13 is easily worn out during a long-term utilization. Thus, the movable sleeve 12 cannot be pushed upward easily to connect the receiving recess 123 of the movable sleeve 12 to the mounting recess 114 of the fixed sleeve 11, so that the lip gloss cannot enter the receiving recess 123 of the movable sleeve 12 easily, thereby choking the lip gloss, and thereby failing the lip gloss and brush assembly.

SUMMARY OF THE INVENTION

In accordance with the present invention, there is provided a lip gloss and brush assembly, comprising a container having an end portion formed with an outlet, a fixed member secured in the outlet of the container and having an inside formed with a mounting recess and a peripheral wall formed with an inlet connected to the mounting recess and an inside of the container, a rotation member rotatably mounted in the mounting recess of the fixed member and having an inside formed with a receiving recess and a peripheral wall formed with a filling hole connected to the receiving recess and the mounting recess of the fixed member, a brush mounted in and partially protruded outward from the receiving recess of the rotation member, and a cover mounted on the outlet of the container to cover the brush and secured to the rotation member to rotate the rotation member.

The primary objective of the present invention is to provide a lip gloss and brush assembly, wherein the cover is rotated to rotate the rotation member to open or close flow of the lip gloss contained in the inside of the container, so that the lip gloss and brush assembly is operated easily and conveniently, thereby facilitating the user operating the lip gloss and brush assembly.

Another objective of the present invention is to provide a lip gloss and brush assembly, wherein when the rotation limit portion of the rotation member is rotatable to abut one side of the rotation limit flange of the fixed member, the filling hole is movable to align with the inlet of the fixed member to allow entrance of the lip gloss, thereby facilitating the user rotating the rotation member to control the flow of the lip gloss contained in the inside of the container.

A further objective of the present invention is to provide a lip gloss and brush assembly, wherein the flow of the lip gloss is controlled by rotation of the cover, so that the lip gloss is allowed to flow smoothly and constantly without being choked or jammed, thereby enhancing the working condition of the lip gloss and brush assembly.

Further benefits and advantages of the present invention will become apparent after a careful reading of the detailed description with appropriate reference to the accompanying drawings.

DETAILED DESCRIPTION OF THE INVENTION

Figure 1:
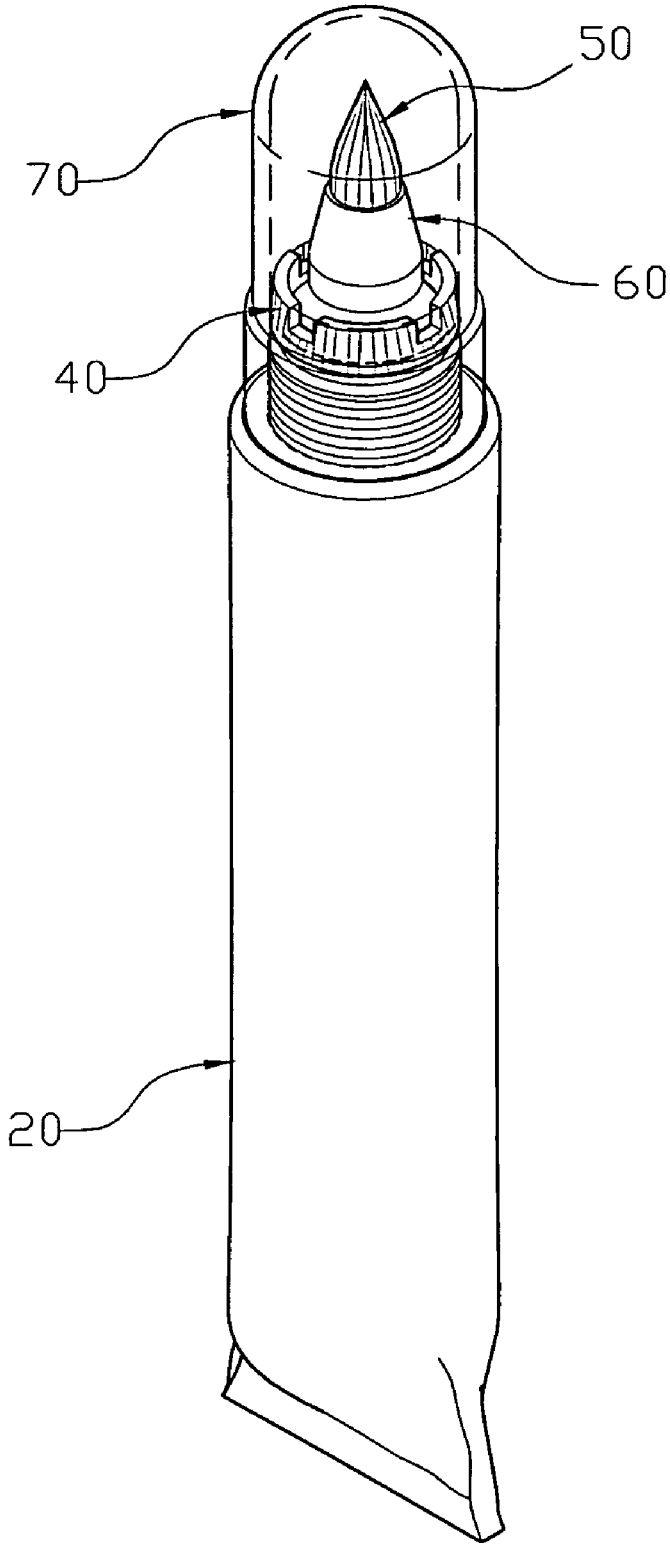
FIG. 1 is a perspective view of a lip gloss and brush assembly in accordance with the preferred embodiment of the present invention.
Figure 2:
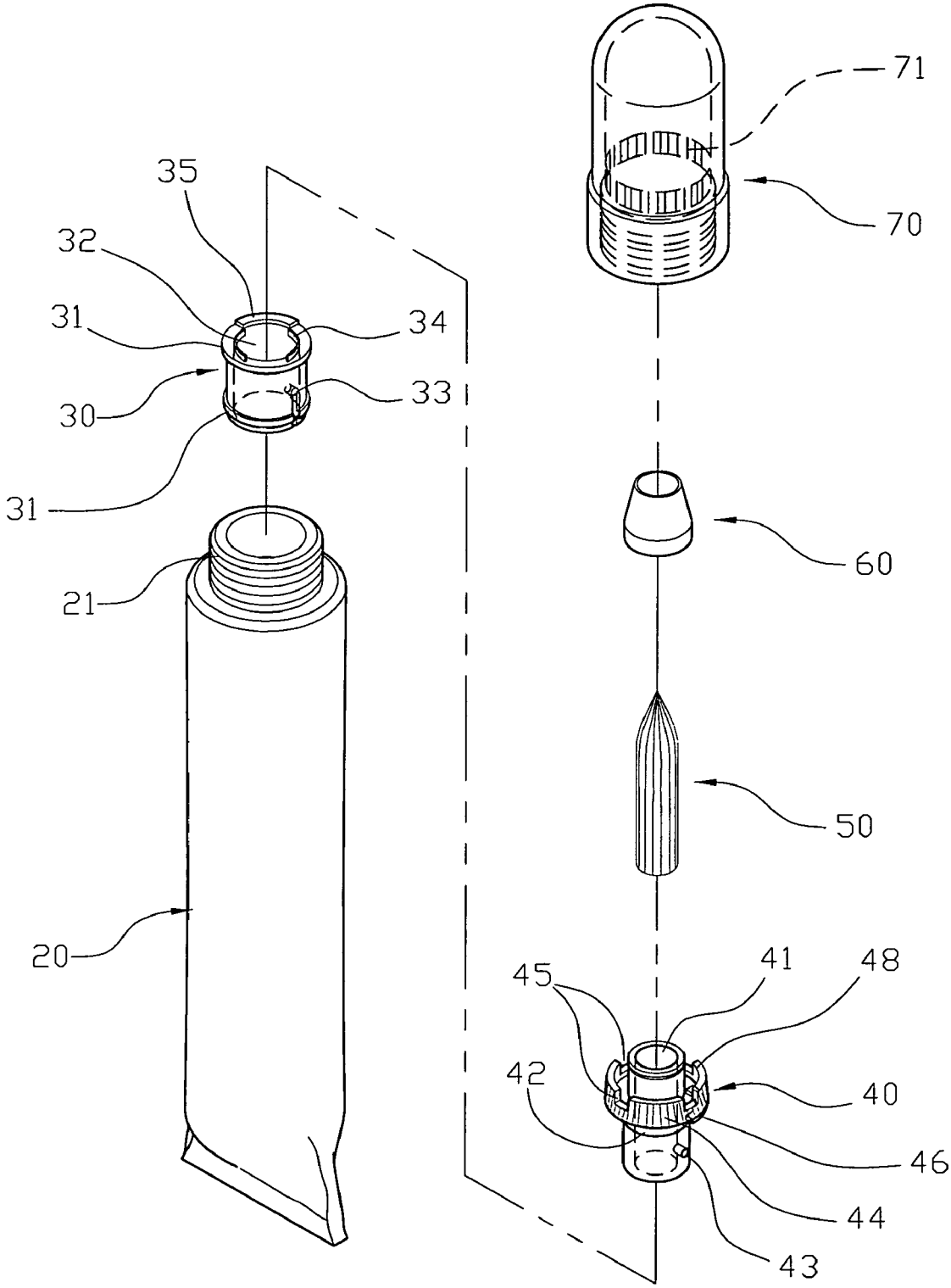
FIG. 2 is an exploded perspective view of the lip gloss and brush assembly as shown in FIG. 1.
Figure 3:
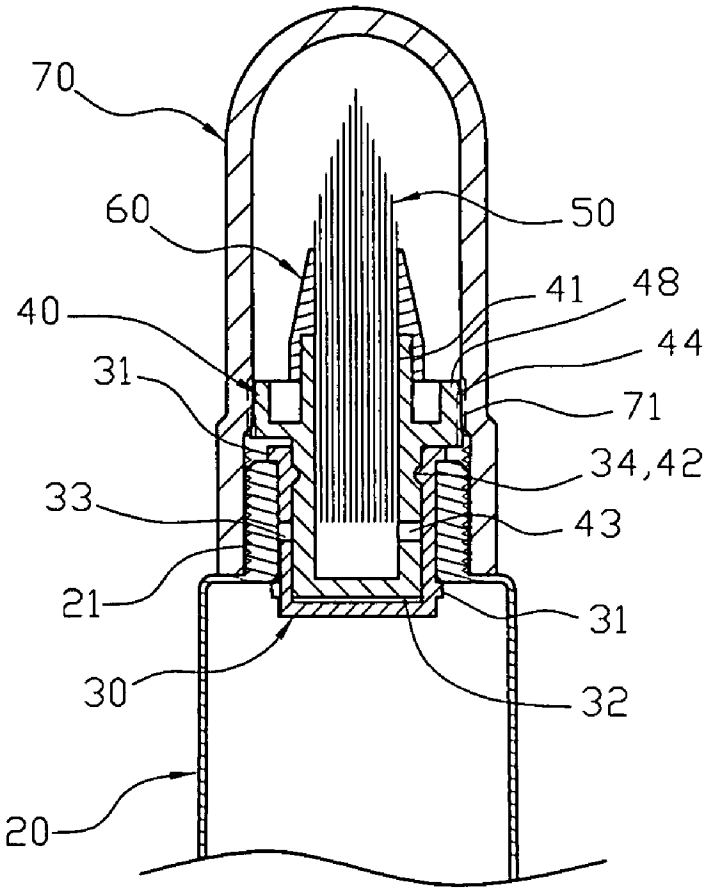
FIG. 3 is a plan cross-sectional view of the lip gloss and brush assembly as shown in FIG. 1.

Referring to the drawings and initially to FIGS. 1-3, a lip gloss and brush assembly in accordance with the preferred embodiment of the present invention comprises a container 20, a fixed member 30, a rotation member 40, a brush 50, a retaining cap 60, and a cover 70.

The container 20 is a soft compressible body and contains a lip gloss therein. The container 20 has an end portion formed with an outlet 21 having an outer thread.

The fixed member 30 is secured in the outlet 21 of the container 20 and has an inside formed with a mounting recess 32 and a peripheral wall formed with an inlet 33 connected to the mounting recess 32 and an inside of the container 20. The fixed member 30 has two ends each formed with an outwardly extending locking flange 31 locked on the outlet 21 of the container 20 to secure the fixed member 30 to the outlet 21 of the container 20. The fixed member 30 has a top portion formed with a substantially arc-shaped rotation limit flange 35. The mounting recess 32 of the fixed member 30 has a wall formed with at least one substantially arc-shaped guide rail 34.

The rotation member 40 is rotatably mounted in the mounting recess 32 of the fixed member 30 and has an inside formed with a receiving recess 41 and a peripheral wall formed with a filling hole 43 connected to the receiving recess 41 and the mounting recess 32 of the fixed member 30. Thus, the filling hole 43 is movable with the rotation member 40 to align with the inlet 33 of the fixed member 30 to connect the receiving recess 41 of the rotation member 40 to the inside of the container 20. The rotation member 40 has an outer wall formed with a substantially annular guide groove 42, and the guide rail 34 of the fixed member 30 is rotatably mounted in the guide groove 42 of the rotation member 40 during rotation of the rotation member 40. The rotation member 40 has a mediate portion formed with an outwardly extending seat portion 48 protruding outward from the mounting recess 32 of the fixed member 30 and having a bottom portion formed with a rotation limit portion 46 that is rotatable to abut one side of the rotation limit flange 35 of the fixed member 30 to limit rotation of the rotation member 40 so that the rotation member 40 is limited to rotate through a determined rotation angle. The seat portion 48 of the rotation member 40 has a substantially annular shape and has an outer face provided with a plurality of axially extending engaging teeth 44. The seat portion 48 of the rotation member 40 has a peripheral wall formed with a plurality of slits 45 so that the seat portion 48 of the rotation member 40 is flexible.

The brush 50 is mounted in and partially protruded outward from the receiving recess 41 of the rotation member 40.

The retaining cap 60 is mounted on the rotation member 40 to retain the brush 50 in the rotation member 40.

The cover 70 is mounted on the outlet 21 of the container 20 to cover the brush 50 and is secured to the rotation member 40 to rotate the rotation member 40. The cover 70 has an inner wall pressing the seat portion 48 of the rotation member 40 and formed with a plurality of axially extending engaging teeth 71 engaged with the engaging teeth 44 of the rotation member 40 so that the cover 70 is secured to the rotation member 40 to rotate the rotation member 40.

Figure 4:
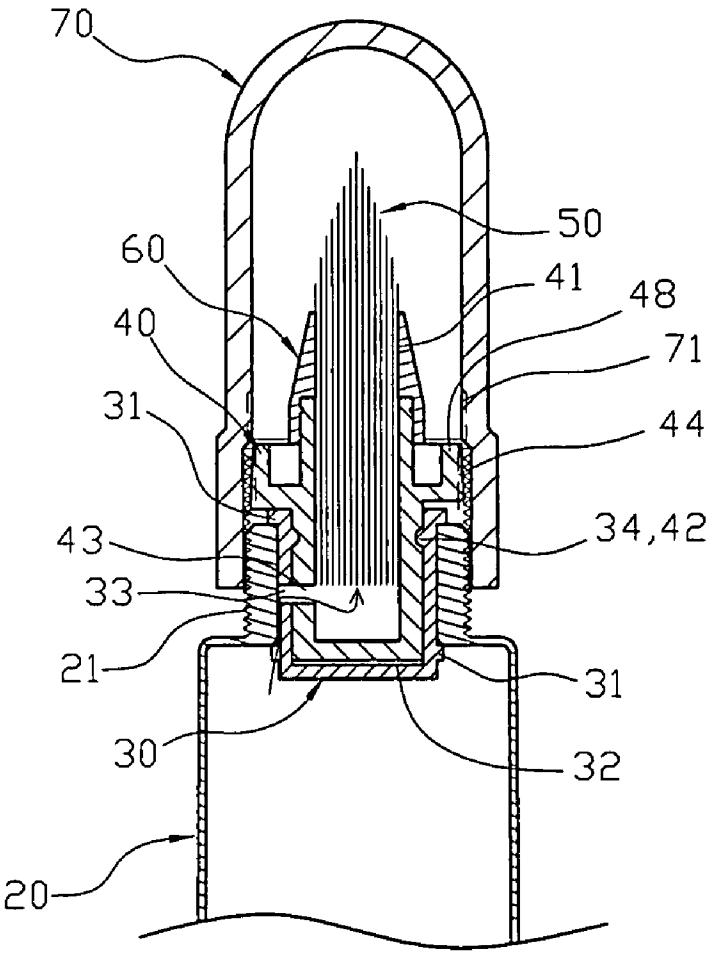
FIG. 4 is a schematic operational view of the lip gloss and brush assembly as shown in FIG. 3.

As shown in FIGS. 3 and 4, the engaging teeth 71 of the cover 70 are engaged with the engaging teeth 44 of the rotation member 40 so that the rotation member 40 is rotated by the cover 70 when the cover 70 is rotated. When the rotation member 40 is rotated by the cover 70, the filling hole 43 is movable with the rotation member 40 to align with the inlet 33 of the fixed member 30 to connect the receiving recess 41 of the rotation member 40 to the inside of the container 20. Thus, when the container 20 is compressed by a user, the lip gloss contained in the inside of the container 20 is compressed to flow through the inlet 33 of the fixed member 30 and the filling hole 43 into the receiving recess 41 of the rotation member 40 to be absorbed by the brush 50 for use with the user after the cover 70 is removed from the outlet 21 of the container 20.

At this time, when the rotation limit portion 46 of the rotation member 40 is rotatable to abut one side of the rotation limit flange 35 of the fixed member 30, the filling hole 43 is movable to align with the inlet 33 of the fixed member 30 to allow entrance of the lip gloss, thereby facilitating the user rotating the rotation member 40 to control the flow of the lip gloss contained in the inside of the container 20.

At the same time, after the rotation limit portion 46 of the rotation member 40 is rotatable to abut one side of the rotation limit flange 35 of the fixed member 30, the rotation member 40 is limited by the fixed member 30 and cannot be rotated by the cover 70, so that the cover 70 performs an idle rotation until the cover 70 is removed from the outlet 21 of the container 20.

Figure 5:
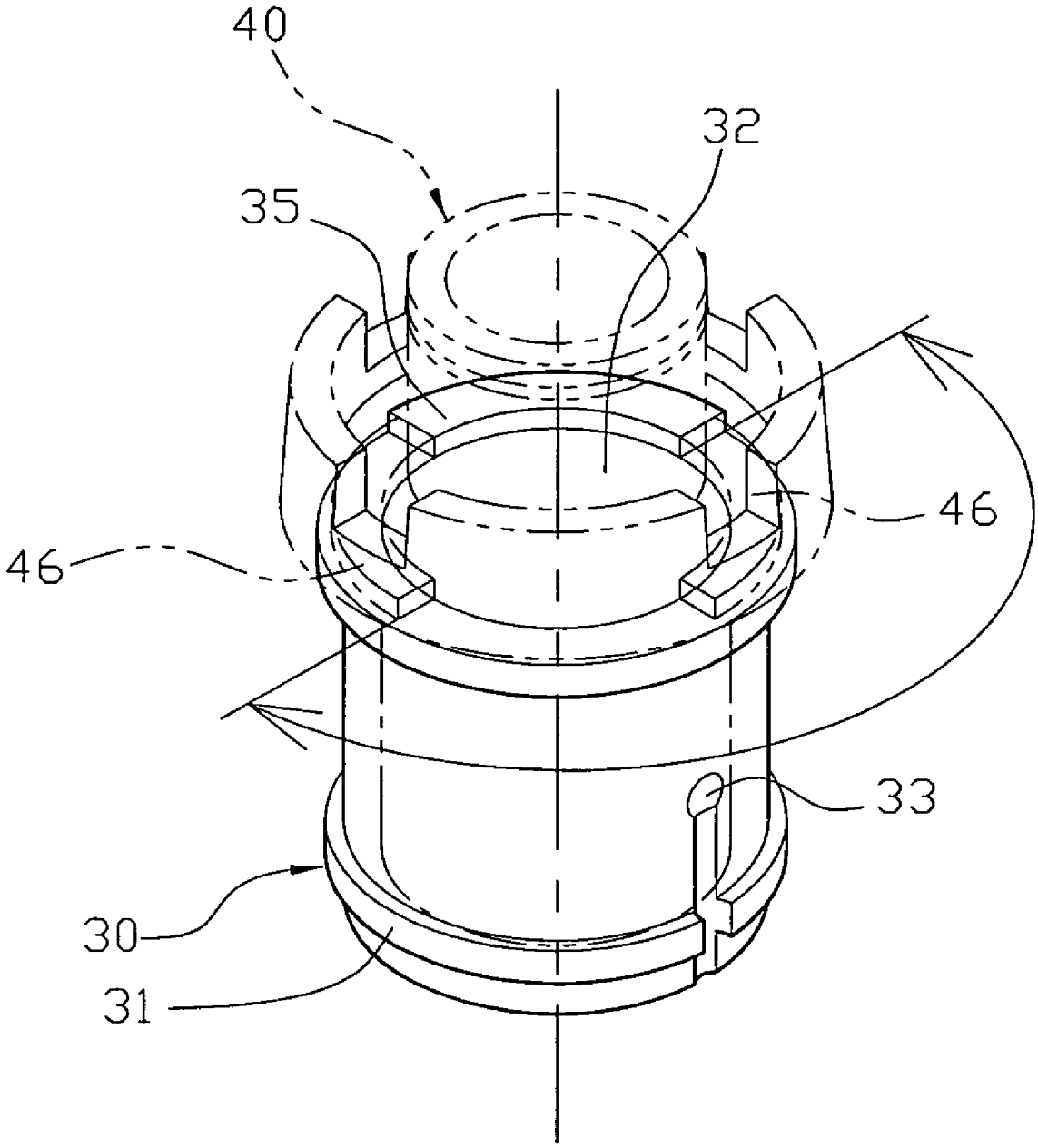
FIG. 5 is a schematic operational view of the lip gloss and brush assembly as shown in FIG. 1.
Figure 6:
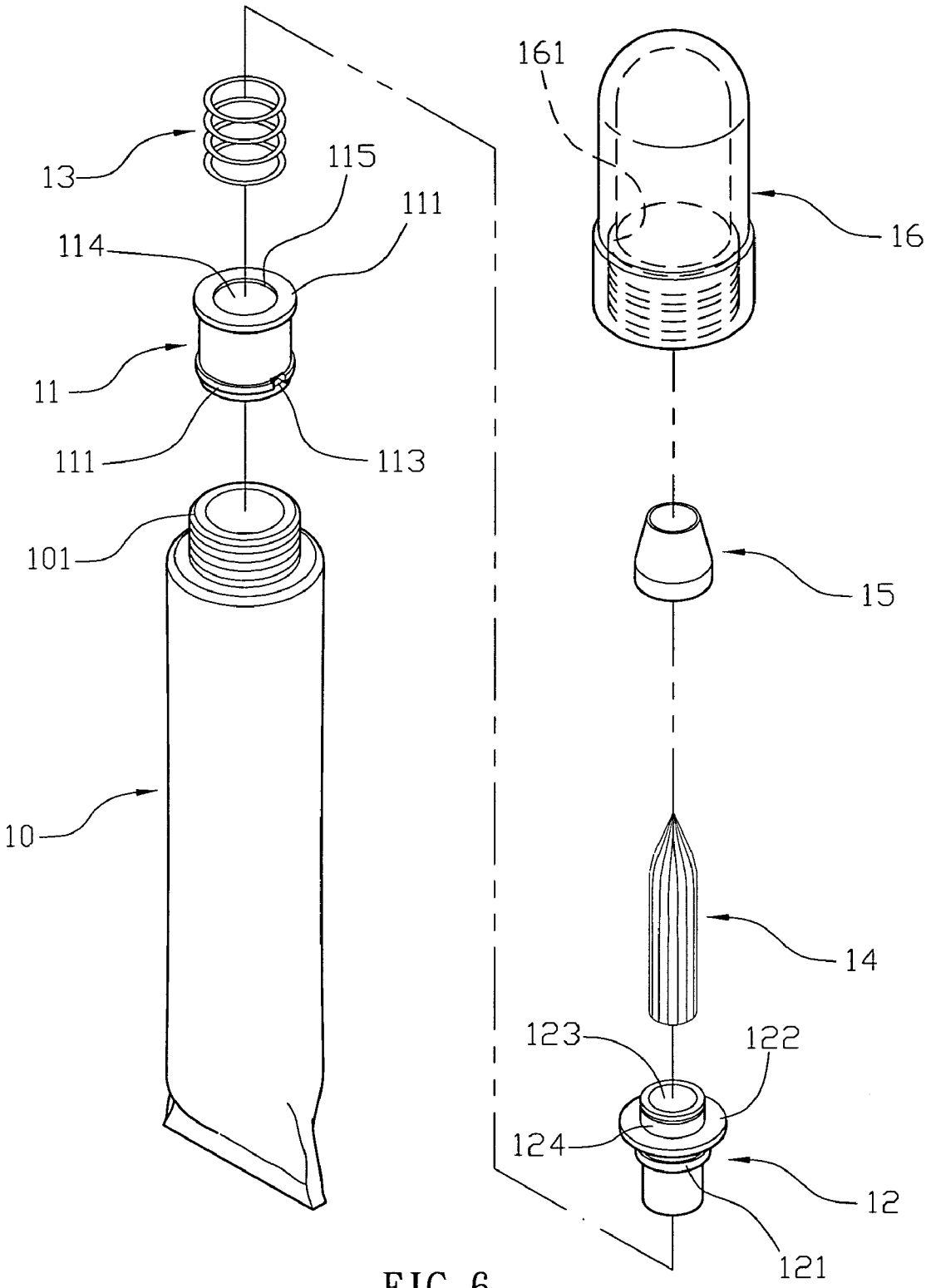
FIG. 6 PRIOR ART
FIG. 6 is an exploded perspective view of a conventional lip gloss and brush assembly in accordance with the prior art.
Figure 8:
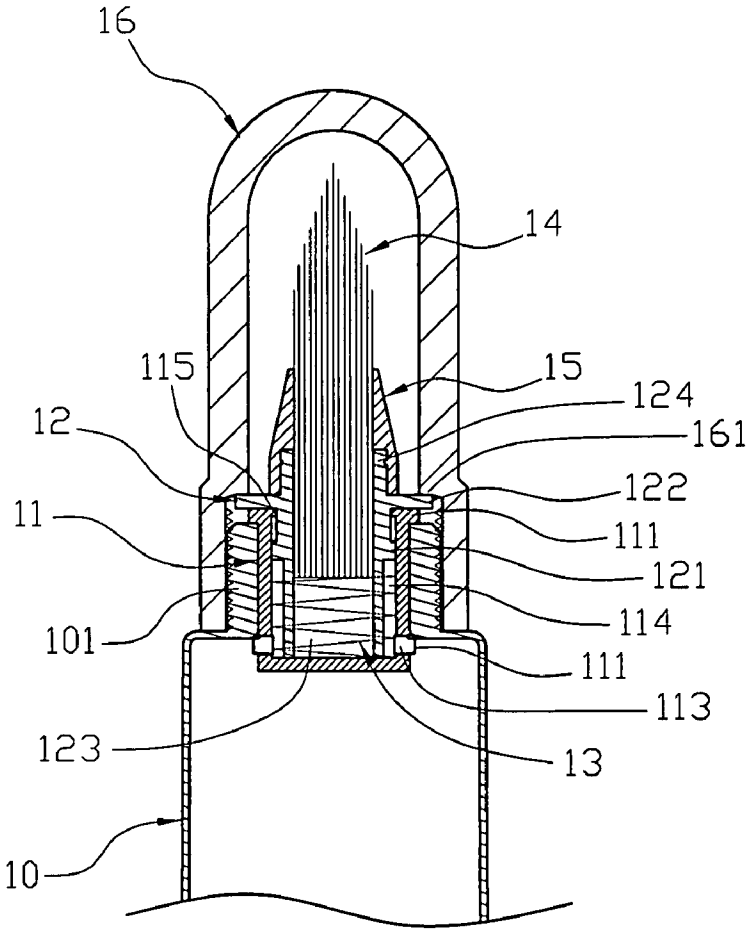
FIG. 8 PRIOR ART
FIG. 8 is a schematic operational view of the conventional lip gloss and brush assembly as shown in FIG. 7.
Figure 7:
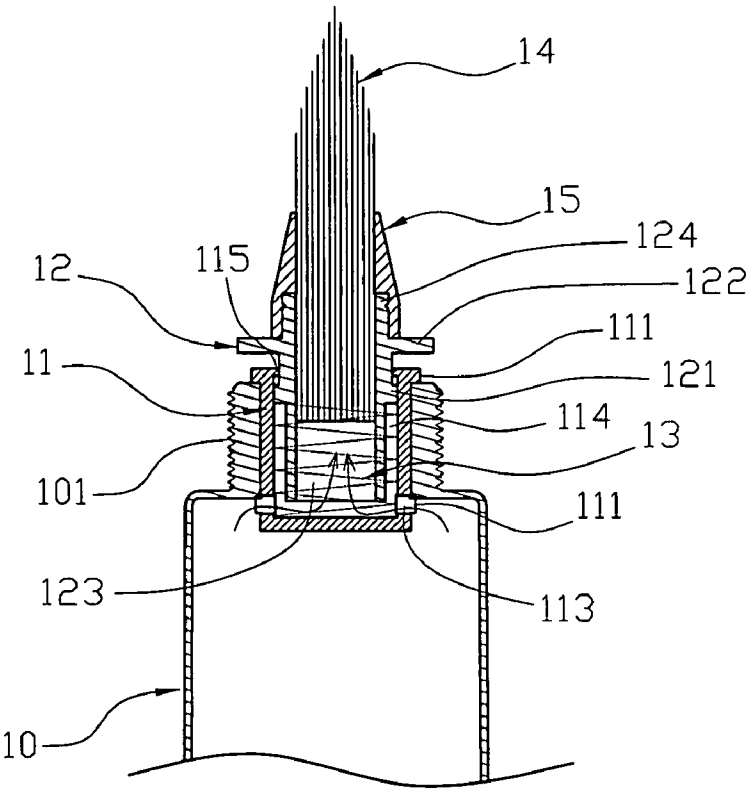
FIG. 7 PRIOR ART
FIG. 7 is a plan cross-sectional assembly view of the conventional lip gloss and brush assembly as shown in FIG. 6.

As shown in FIGS. 3 and 5, the filling hole 43 is movable with the rotation member 40 to a position where the filling hole 43 is separated from the inlet 33 of the fixed member 30 to interrupt the connection between the receiving recess 41 of the rotation member 40 and the inside of the container 20 to prevent the lip gloss contained in the inside of the container 20 from entering the receiving recess 41 of the rotation member 40.

At the same time, after the rotation limit portion 46 of the rotation member 40 is rotatable to abut the other side of the rotation limit flange 35 of the fixed member 30, the rotation member 40 is limited by the fixed member 30 and cannot be rotated by the cover 70, so that the cover 70 performs an idle rotation until the cover 70 is secured to the outlet 21 of the container 20.

Accordingly, the cover 70 is rotated to rotate the rotation member 40 to open or close flow of the lip gloss contained in the inside of the container 20, so that the lip gloss and brush assembly is operated easily and conveniently, thereby facilitating the user operating the lip gloss and brush assembly. In addition, when the rotation limit portion 46 of the rotation member 40 is rotatable to abut one side of the rotation limit flange 35 of the fixed member 30, the filling hole 43 is movable to align with the inlet 33 of the fixed member 30 to allow entrance of the lip gloss, thereby facilitating the user rotating the rotation member 40 to control the flow of the lip gloss contained in the inside of the container 20. Further, the flow of the lip gloss is controlled by rotation of the cover 70, so that the lip gloss is allowed to flow smoothly and constantly without being choked or jammed, thereby enhancing the working condition of the lip gloss and brush assembly.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A lip gloss and brush assembly, comprising:

a container having an end portion formed with an outlet;

a fixed member secured in the outlet of the container and having an inside formed with a mounting recess and a peripheral wall formed with an inlet connected to the mounting recess and an inside of the container;

a rotation member rotatably mounted in the mounting recess of the fixed member and having an inside formed with a receiving recess and a peripheral wall formed with a filling hole connected to the receiving recess and the mounting recess of the fixed member;

a brush mounted in and partially protruded outward from the receiving recess of the rotation member;

a cover mounted on the outlet of the container to cover the brush and secured to the rotation member to rotate the rotation member;

wherein the rotation member has a mediate portion formed with an outwardly extending seat portion having an outer face provided with a plurality of axially extending engaging teeth, and the cover has an inner wall pressing the seat portion of the rotation member and formed with a plurality of axially extendina engaging teeth engaged with the engaging teeth of the rotation member so that the cover is secured to the rotation member to rotate the rotation member.

2. The lip gloss and brush assembly in accordance with claim 1, wherein the filling hole is movable with the rotation member to align with the inlet of the fixed member to connect the receiving recess of the rotation member to the inside of the container.

3. The lip gloss and brush assembly in accordance with claim 1, wherein the seat portion of the rotation member is protruding outward from the mounting recess of the fixed member.

4. The lip gloss and brush assembly in accordance with claim 1, wherein the fixed member has a top portion formed with a rotation limit flange, and the seat portion of the rotation member has a bottom portion formed with a rotation limit portion that is rotatable to abut one side of the rotation limit flange of the fixed member to limit rotation of the rotation member so that the rotation member is limited to rotate through a determined rotation angle.

5. The lip gloss and brush assembly in accordance with claim 4, wherein the rotation limit flange of the fixed member is substantially arc-shaped.

6. The lip gloss and brush assembly in accordance with claim 4, wherein when the rotation limit portion of the rotation member is rotatable to abut one side of the rotation limit flange of the fixed member, the filling hole is movable to align with the inlet of the fixed member to connect the receiving recess of the rotation member to the inside of the container.

7. The lip gloss and brush assembly in accordance with claim 6, wherein when the rotation limit portion of the rotation member is rotatable to abut the other side of the rotation limit flange of the fixed member, the filling hole is movable to separate from the inlet of the fixed member to interrupt a connection between the receiving recess of the rotation member and the inside of the container.

8. The lip gloss and brush assembly in accordance with claim 1, wherein the seat portion of the rotation member has a substantially annular shape.

9. The lip gloss and brush assembly in accordance with claim 1, wherein the seat portion of the rotation member has a peripheral wall formed with a plurality of slits so that the seat portion of the rotation member is flexible.

10. The lip gloss and brush assembly in accordance with claim 1, wherein the mounting recess of the fixed member has a wall formed with at least one guide rail, and the rotation member has an outer wall formed with a guide groove, and the guide rail of the fixed member is rotatably mounted in the guide groove of the rotation member during rotation of the rotation member.

11. The lip gloss and brush assembly in accordance with claim 10, wherein the guide rail of the fixed member is substantially arc-shaped.

12. The lip gloss and brush assembly in accordance with claim 10, wherein the guide groove of the rotation member has a substantially annular shape.

13. The lip gloss and brush assembly in accordance with claim 1, further comprising a retaining cap mounted on the rotation member to retain the brush in the rotation member.

14. The lip gloss and brush assembly in accordance with claim 1, wherein the fixed member has two ends each formed with an outwardly extending locking flange locked on the outlet of the container to secure the fixed member to the outlet of the container.

* * * * *